United States Patent [19]

Marcon et al.

[11] Patent Number: 4,612,843

[45] Date of Patent: Sep. 23, 1986

[54] DUAL AMMUNITION FEED FOR AUTOMATIC WEAPONS

[75] Inventors: Joël Marcon; Jacques Durant, both of Bourges; Georges Simon, Saint Germain Du Puy; Alain Boisseau, Bourges, all of France

[73] Assignee: Etat Francais, Paris, France

[21] Appl. No.: 615,262

[22] Filed: May 30, 1984

[30] Foreign Application Priority Data

Jun. 3, 1983 [FR] France ..... 83 09920

[51] Int. Cl.[4] ..... F41D 10/32

[52] U.S. Cl. ..... 89/33.04; 89/33.25

[58] Field of Search ..... 89/33.01, 33.04

[56] References Cited

U.S. PATENT DOCUMENTS

| | | | |
|---|---|---|---|
| 3,452,640 | 7/1969 | Maillard | 89/33.04 |
| 3,662,646 | 5/1972 | O'Brien et al. | 89/33.04 |
| 3,995,527 | 12/1976 | Schiele et al. | 89/33.04 |

FOREIGN PATENT DOCUMENTS

| | | |
|---|---|---|
| 1224730 | 6/1960 | France . |
| 1537614 | 8/1968 | France . |
| 1576739 | 8/1969 | France . |
| 2372410 | 6/1978 | France . |

OTHER PUBLICATIONS

Shigley, Joseph E., Kinematic Analysis of Mechanisms, 1969, pp. 314–315.

*Primary Examiner*—Stephen C. Bentley
*Attorney, Agent, or Firm*—Parkhurst & Oliff

[57] ABSTRACT

A dual ammunition feed for automatic weapons includes a positioning device for the ammunition wherein a central positioning sprocket unit interacts with two feed sprocket units in two separate feed casings to allow for loading with two different types of ammunition. The feed casings are tiltable into and out of engagement with the positioning device, the tilting of a particular feed casing into engagement with the positioning device being followed by the simultaneous disengagement of the other feed casing from the positioning device. The tilting of a particular feed casing into engagement further results in the coupling of the engaged feed casing's feed sprocket unit with a reducing transmission driven by an external motor, and in a change in the rotational direction of the central positioning sprocket unit such that the central positioning sprocket unit always rotates in an opposite direction from that of the feed sprocket unit of the particular feed casing which is engaged.

16 Claims, 20 Drawing Figures

FIG. 7
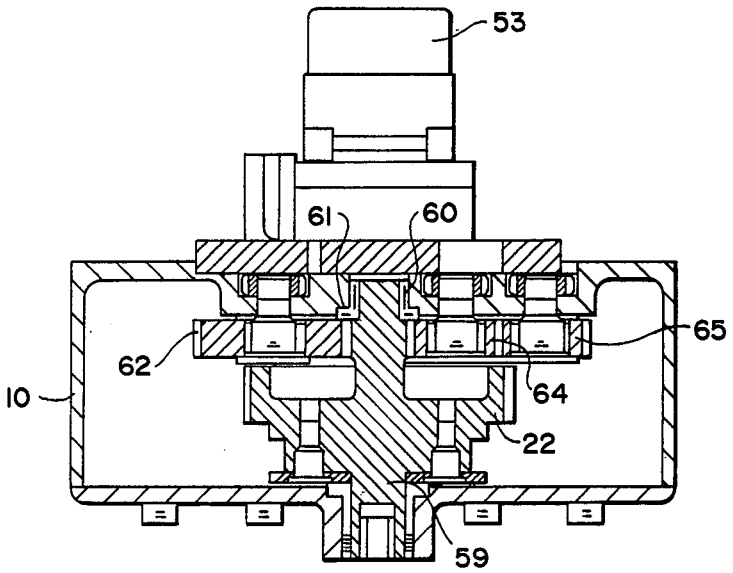
FIG. 8
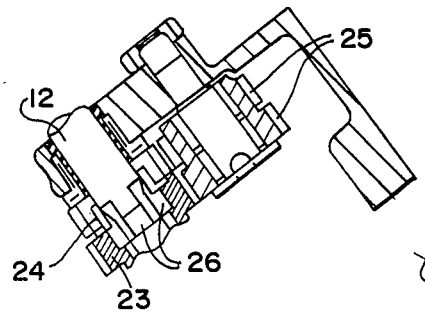
FIG. 9
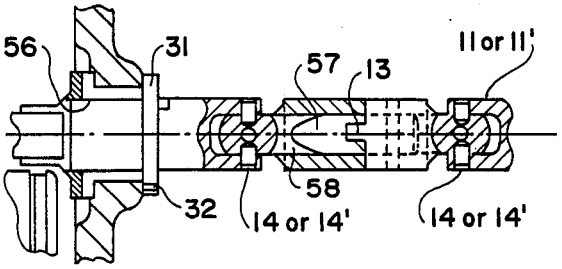
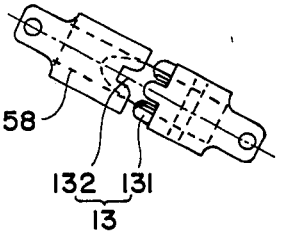
FIG. 10

DUAL AMMUNITION FEED FOR AUTOMATIC WEAPONS

BACKGROUND OF THE INVENTION

The technical sector of this invention is that of automatic firearms and in particular weapons which can use, upon request by the user, two different kinds of ammunition, for instance penetrating ammunition and explosive ammunition.

We are already familiar with FR Pat. No. 1,576,739 which describes a weapon with two conveyors that are parallel to the axis of the weapon, which includes at the level of the conveyors a stripping station where the ammunition is stripped from its tray by a lengthwise shift triggered by a pusher that is part of the breech of the weapon and, in front of this stripping station, a distribution station which includes a main insertion location designed to accommodate the first cartridge to be inserted into the barrel of the weapon and two symmetrical waiting locations, each of those waiting locations corresponding to one of the rotors of the conveyors and designed to accommodate a cartridge from the corresponding belt stemming from said stripping station.

This device possesses proper accuracy in the conveying of the ammunition but it displays the disadvantage of increasing weapon length.

We also are familiar with U.S. Pat. No. 3,622,646 where the ammunition taken from a feed sprocket unit is brought in line with the axis of the breech by means of a mobile slide or tray assembly which is shiftable crosswise to the weapon.

The disadvantage displayed by both devices is that, when an ammunition choice has been made, we are forced to fire the last ammunition from the previously selected cartridge belt, which can hamper fire accuracy.

FR Pat. No. 1,537,614 unveils a weapon which includes two tilting feed devices so that one is set when the other is shifted out of reach from the axis of the breech.

The disadvantage underlying this device is the drive of the feed belt which displays operating jolts, leading to a chance of rupture or unhooking of the link, thus resulting in a halting of fire.

SUMMARY OF THE INVENTION

The purpose of this invention is to achieve a device of the same kind as the one in the last mentioned patent which makes it possible to fire the first ammunition from the selected beltloader.

Another purpose of the invention is to supply a compact easy-to-use device, which makes it possible to insert, at the onset of use, the feed-belts without disassembly, which is not the case for the weapon described in the previously mentioned FR Pat. No. 1,537,614.

One purpose of the invention is also to supply weapon kinematics suited to automatic use of a dual feed without any manual intervention other than that of selecting the kind of ammunition to use.

The invention is also designed to display a feed device which is usable at high fire rate and that can be suited to a large number of weapon categories, like automatic weapons with external motors, as it will later be described or with very slight changes within the understanding of a man skilled in the art, to automatic weapons with inertial breech or use of gas.

Without exceeding the framework of the invention, the dual feed device which is described later in conjunction with a weapon with a recoiling breech can also be adapted to a weapon with a recoiling barrel.

Therefore, the invention pertains to a dual feed device for a weapon with external motor feed and a rectilinearly shifting breech, a device which includes a positioning device for the ammunition that includes a central positioning sprocket unit and also two feed casings loaded with various ammunition arranged on either side of the central positioning sprocket unit and connected to one another by a support, the two casings being able to tilt around axes which are parallel to the lengthwise axis of the weapon, a device of which each feed casing includes a feed sprocket unit and of which each casing is able, with its tilt, to be clutched to the positioning device by coupling its feed sprocket unit onto a reduction transmission stemming from the external motor, the clutching of the first casing followed by the simultaneous throwing out of gear of the second feed casing from the positioning device by uncoupling its feed sprocket unit from the reduction transmission, and the tilt of the casings causing a change in the rotational direction of the central positioning sprocket unit.

According to a characteristic of the invention, if the weapon is a firearm with an external motor driving the alternate rectilinear motion of the breech, we anticipate that the output shaft of the motor also ensures the setting of the reducing transmission located in a reducing box placed at the rear of the weapon and guiding two driving axles from the feed casings and a third driving axle from the ammunition central positioning sprocket unit.

Furthermore, the invention anticipates that the transmission guiding the two driving axles from the feed casings is a continuous reduction transmission, the driving axle of the first feed casing turning in the direction opposite that of the second feed casing and that, when combined, the motion transmitted to the third driving axle of the central sprocket turns the central sprocket in the opposite direction of the driving axle of the feed casing clutched to the positioning device.

The device according to the invention also includes a control device for the tilt of the feed casings around their rotational axes, the tilt control activating a coupling system for the driving axle of the casing which becomes clutched to the positioning device with a universal joint on the rotation axle of the feed sprockets of said casing, which activates simultaneously an uncoupling system for the driving axle of the second casing, and a system for changing the rotational direction of the central positioning sprocket, so that the rotational direction of the central sprocket is always the reverse of that of the feed sprocket unit clutched to the positioning device.

According to another characteristic, the control device for tilting the casings includes a control lever which cooperates with a feed casing locking means at each tilted position, the control lever then being locked onto the reducing case of the weapon.

According to one mode of the invention, the control lever for tilting the casings is connected to a mobile toothed sector around an axis which cooperates with a rack borne by the support that is shared by the two feed casings.

In order to obtain a change in the rotational direction of the central sprocket during the casing tilt, the device includes:

a non-reversing wheel gear for the step-by-step transmission of rotational direction to the central sprocket, a reversing gear which can be series adapted with the wheel gear, when it is coupled to a driving axle, and a claw coupling axle, which is mobile in the lengthwise direction of the weapon, an axle driven by a fork that is connected to said claw coupling axle and engaged on a ramp that is sloped according to the lengthwise axis of the weapon or on a cam, connected to the support that is shared by the two casings, the tilt of the casings leading to the shift of the ramp which is perpendicular to the axis of the weapon and therefore the lengthwise shift of the axle from an initial position where it is uncoupled from the reversing gear toward a second position where it is coupled to the reversing gear so as to reverse the direction of motion of the central sprocket.

In a variation, the step-by-step rotational motion transmission of the central sprocket unit can be achieved with a cam system known as the "Fergusson system", or in another preferred variation, it shall be comprised of a rotating crank-pin which is connected to a crosswheel.

Furthermore, in order to allow the transition from one kind of feed to another without risking a disfunction, the rotation axle of the feed sprocket unit of each casing carries a shoulder that includes indexing grooves and each casing carries a mobile indexing lever against the strength of a spring. When the casing is cleared from the positioning device, the first end of the lever cooperates with a groove of the shoulder of the sprocket unit axle, the second end of the lever being free to connect the feed sprocket unit of said casing into rotation, the second end of the indexing lever acting as a support on a static girder of the breech case of the weapon, the first end of the lever then being cleared from the sprocket unit axle groove.

Preferably the axle of each feed sprocket unit includes as many grooves which are regularly distributed along its periphery as the feed sprockets have branches or teeth.

According to a characteristic of the invention, the shape of the indexing lever and the size of the coupling system of the casing driving axle are defined in order to allow indexing of the feed sprocket axle in relation to the casing prior to uncoupling of the casing driving axle when the casing tilts in a cleared position, and the deindexing of the sprocket axle in relation to the casing after coupling of the casing driving axle when the casing tilts in the engaged position onto the positioning device, sprocket axle indexing entering when the weapon is in the position where the breech is engaged with the trigger.

According to another specific aspect of the weapon according to the invention, the central sprocket unit includes n teeth which define n chambers, n being at least equal to 3, each chamber able to accommodate ammunition brought in by the engaged casing feed sprocket and coming in succession through a rotation of $2\pi/n$ turns, from a position where the ammunition is waiting, to a positioning station, then to an ejection position of the ammunition shell. In that instance, during the tilt of feed casings, the central sprocket unit changes rotational direction, the ejection position then becoming the waiting station of the ammunition which is conveyed by the second casing that it engaged and the waiting position becoming an ejection position.

According to another characteristic of the invention, in order to make it possible to initially fire the first ammunition from the selected feed casing, each feed casing has a curved ammunition guide which includes a front fork and a rear fork, the guide bringing the ammunition towards the casing feed sprocket unit, and from the feed sprocket unit to the central sprocket unit in the waiting position, and the free section of the front fork of the ammunition guide has a curved head which covers the ammunition in its position at the waiting station of the central sprocket, a head which can withdraw the ammunition from the waiting station during the clearing tilt of the feed casing in relation to the breech case, during its withdrawal the ammunition leaning on a floor guide which is connected to the breech case.

According to another mode of the invention, each feed casing has a channel to bring in the linked ammunition belt through the bottom of the casing and an ejection orifice of the links placed on top of the casing. The casing has a link guide placed along the entire length of the ammunition intake and link ejection channel, the link guide including a dual groove which cooperates with a dual tongue for each link in order to allow stripping of the ammunition by the casing feed sprocket unit.

Furthermore, if the ejection of the shell from the ejection station is performed toward the front of the weapon, the device includes a free ejection guide which is in rotation in relation to the axis of the central sprocket unit and symmetrical in relation to the lengthwise axis of the weapon, rotation being controlled by the tilt of the feed casings, the guide being positioned in each of its operating positions with a thrust in relation to a static girder connected to the breech case and the ejection guide including circular lengthwise guidance spans for the shell during its ejection.

Furthermore, if the positioning central sprocket unit has n teeth and each feed sprocket unit has n' teeth, then the reduction ratio between the motion supplied to the reducing transmission by the control drum of the bolt and the axle of the central sprocket unit is equal to n, the reduction ratio between said motion supplied to the reducing transmission and the driving axle of each feed sprocket unit being equal to n stepped up to n'.

The invention will be described in more detail hereinafter and its operation will be rendered explicit through an automatic weapon with external motor, without its representing a limitation on the application of the device according to the invention which can be easily matched through simple adapting to any other kind of weapon, and especially a weapon which operates with gas or with an inertial breech.

BRIEF DESCRIPTION OF THE DRAWINGS

In order to understand the invention, figures have been attached in which:

FIG. 7 is a section according to AA of FIG. 5;

FIG. 8 is a partial section according to FF of FIG. 5;

FIG. 9 is a left view of one of the two driving axles of the feed casings;

FIG. 10 constitutes a detail of the coupling borne by a driving axle of the feed casing;

FIG. 13 displays the left feed casing in a view from below according to K of FIG. 12*a.

DESCRIPTION OF THE PREFERRED EMBODIMENTS

As it will be described below, the invention applies especially, but not only to, automatic weapons equipped with an external motor. Such weapons include in a known way a barrel of which the axis is static in relation to a breech case; a cartridge chamber within the breech case at the rear of the barrel; a rotating drum of which the lateral face bears a closed-shape helicoidal control ramp; a tracking organ or bolt which cooperates with that ramp and that is connected to one of the two parts comprised of the barrel or the breech, said part being guided in a translation by the breech case and parallel to said axis; and an external motor which is able to make the drum turn in a continuous direction around an axis that is parallel to that of the barrel, the ramp including two segments which are tilted in opposed directions that respectively ensure the projection and recoil of the bolt in a translation motion, and that are joined on one side by a non-tilted part which guarantees the immobilization of that bolt during the time lapse that corresponds to the duration of the shot and the emptying of the gasses and, on the other side, by a part which corresponds to the feed. The external motor is usually electric but it can also be hydraulic, pneumatic or other.

Generally, when a dual feed is associated to the breech, the mode for changing the direction of the feed involves a reversal of motor rotation. We will later see that in this invention the planned device makes it possible to change the feed without changing the rotational direction of the external motor nor, therefore, the drum.

For every operating cycle of the weapon, the motor makes the drum turn in such a way that the bolt travels on the closed shape of the ramp once and thus it closes and opens the cartridge chamber.

All of those elements are known in a conventional way and an implementation example has already been displayed in FR Pat. No. 2,372,410. Hence, those elements have not been addressed by a particular figure and only those elements (drum, bolt or breech case for instance) which are needed to understand the invention have been shown and referenced.

Figure 1:
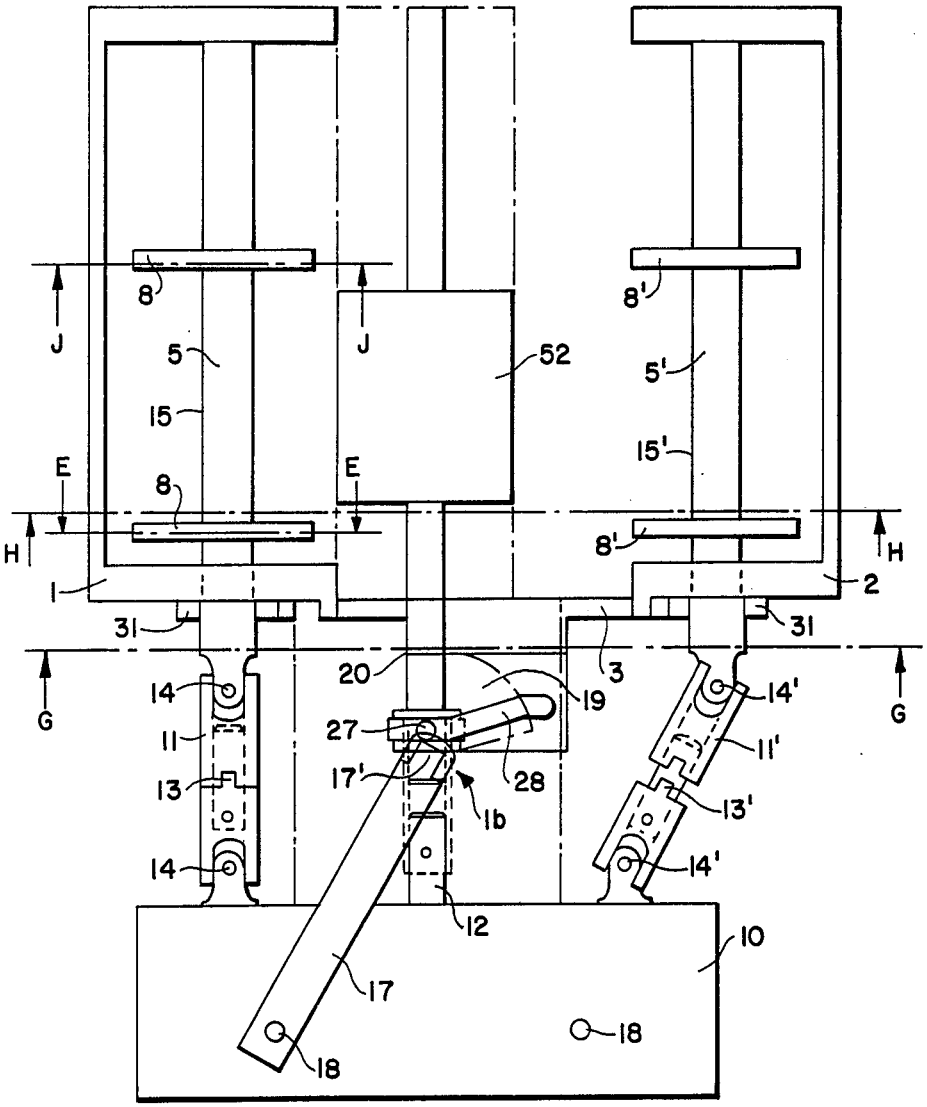
FIG. 1 is a view from above of the device, the linkage means between the casings having been removed, with the left casing engaged.
Figure 2:
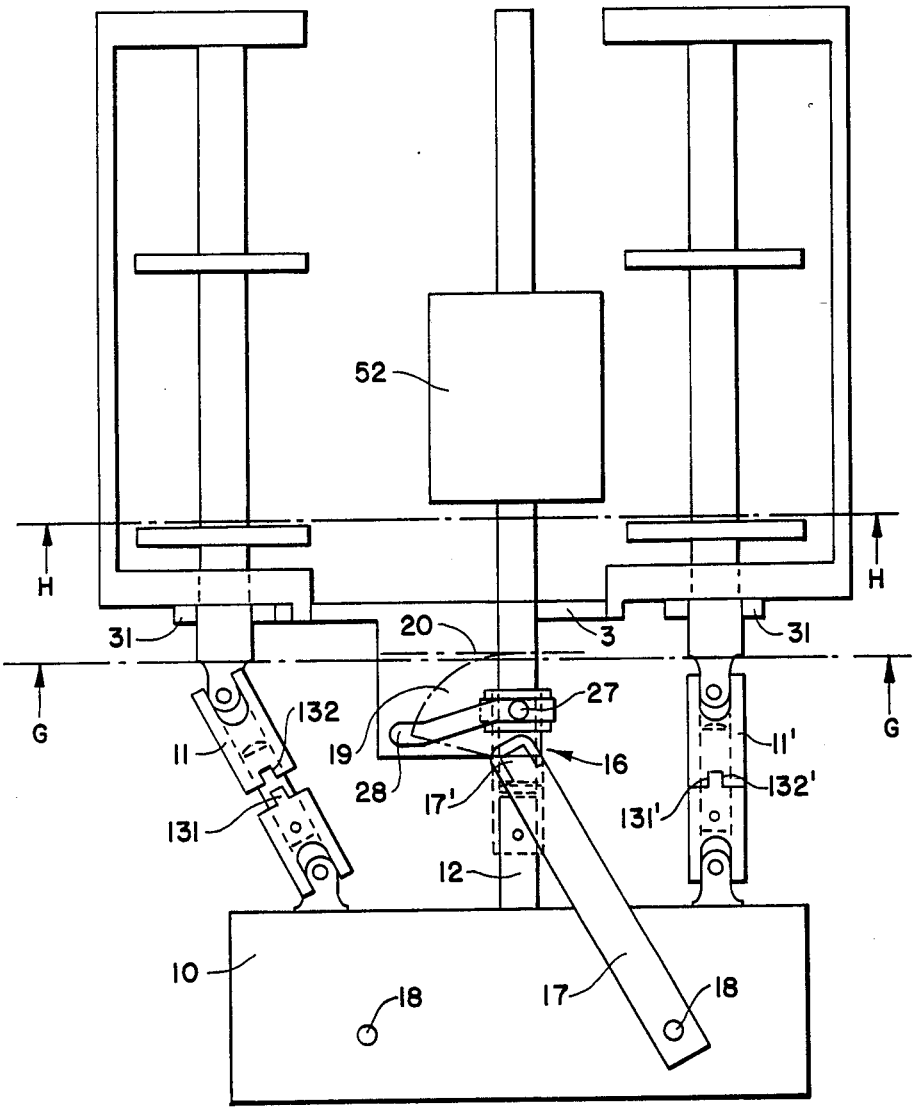
FIG. 2 is an identical view with the right casing engaged.
Figure 6:
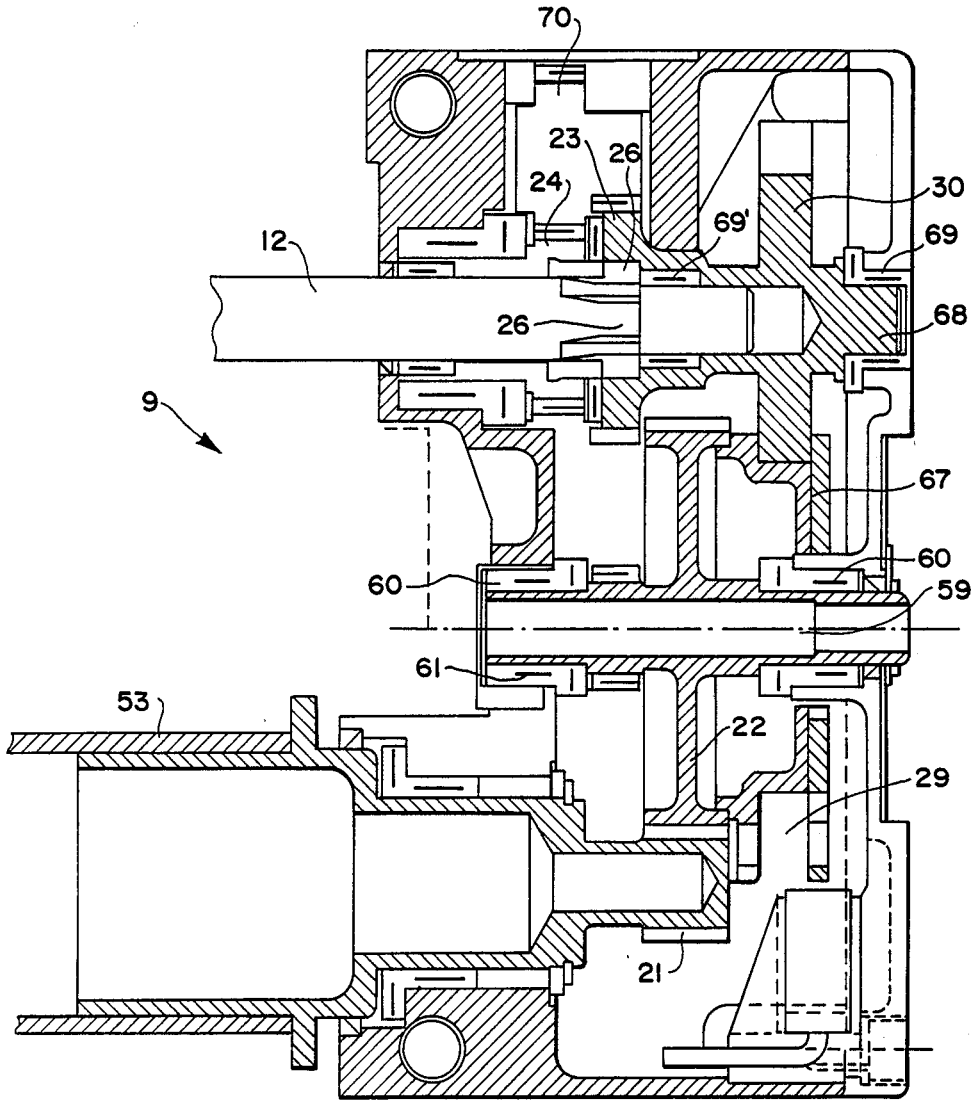
FIG. 6 is a section according to BB of FIG. 5.

The bolt 52 and the contactor-controller (control drum) 53 as described are shown respectively in FIGS. 1, 2 and 6 of this description.

According to the invention, the dual feed device includes two feed casings 1 (left casing) and 2 (right casing) which are located on either side of a positioning device which itself includes a central sprocket unit 7 for positioning ammunition.

The central sprocket unit 7 of the positioning device (FIG. 11) rotates about an axis 6 and can be placed in a rotation sequentially in one or another direction, according to the type of feed that is selected, with a driving axle 12 driven by a reducing transmission 9 placed in a case 10 located to the rear of the weapon which will be described below.

Figure 11A:
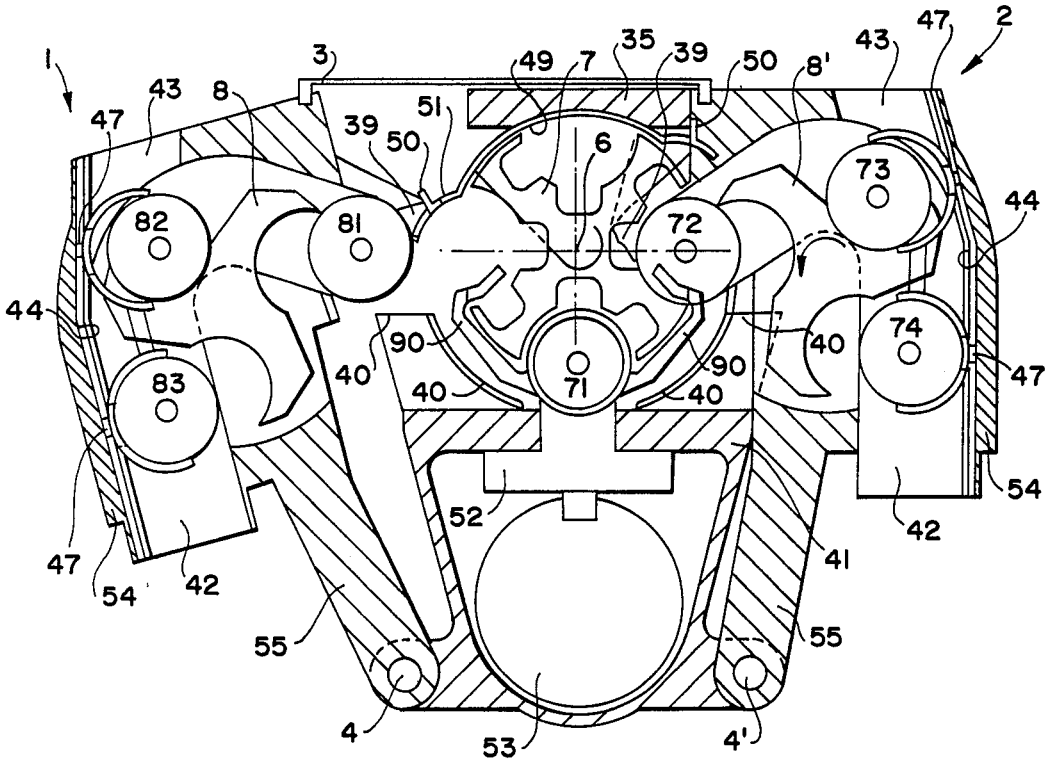
FIGS. 11*a* and 11*b* are sections according to HH of FIG. 2.
Figure 11B:
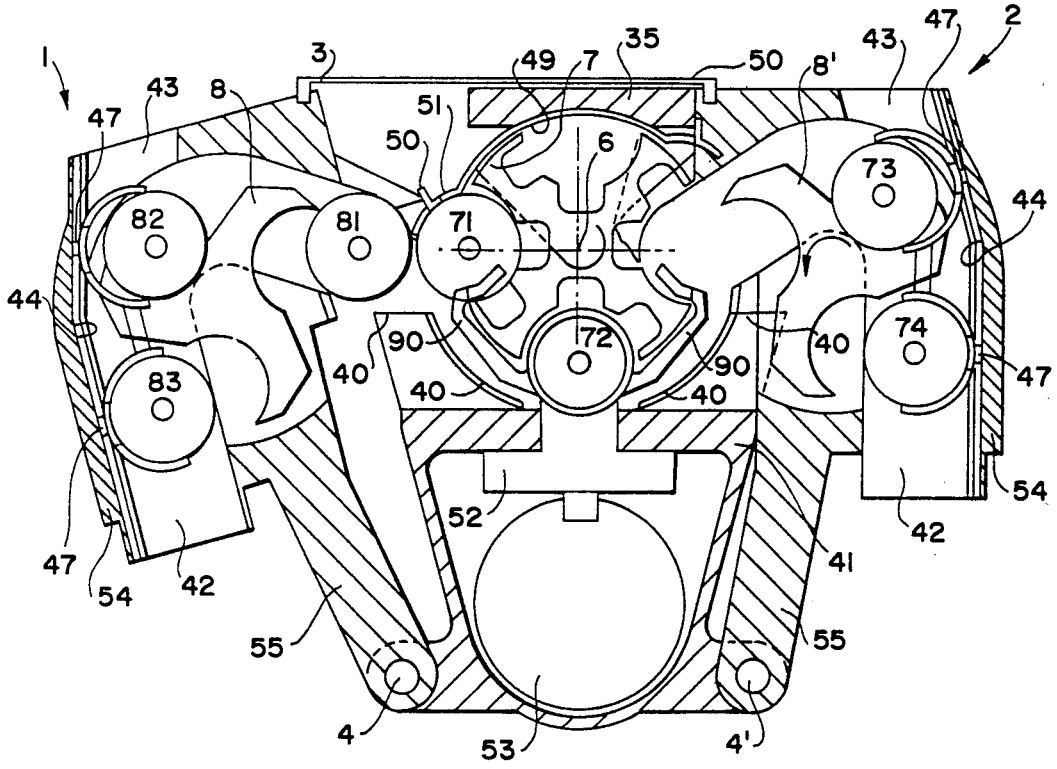
Figure 11C:
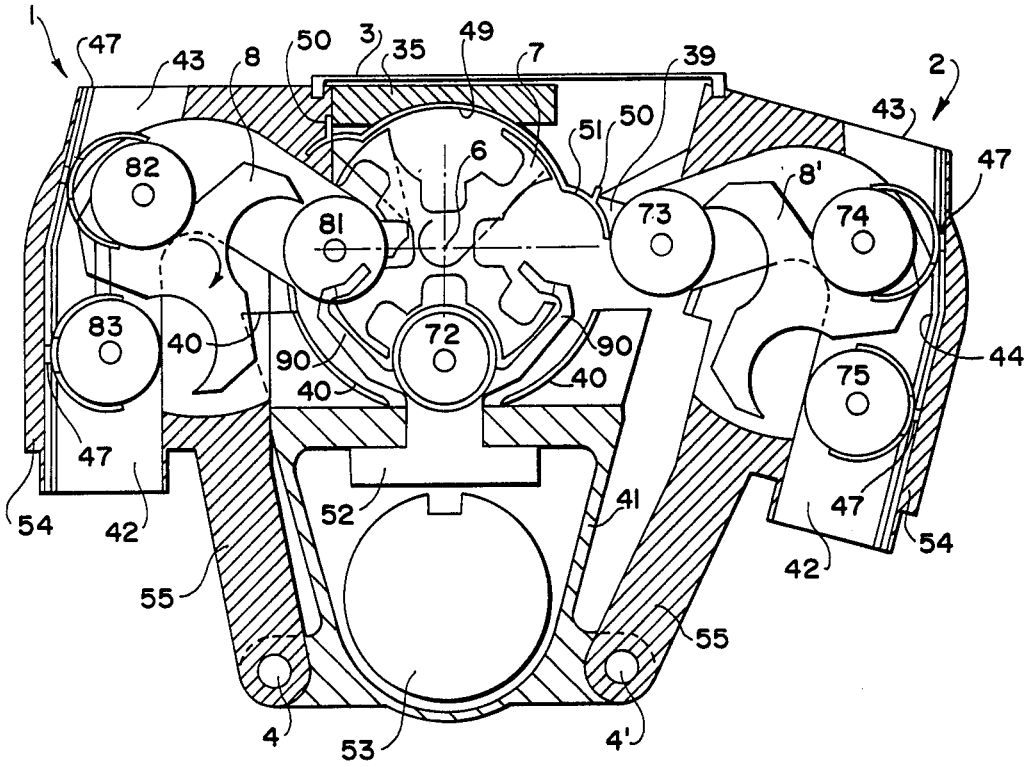
FIGS. 11*c*, 11*d* and 11*e* are sections according to HH of FIG. 1, showing the dual feed device according to the invention at various successive operating moments.
Figure 11D:
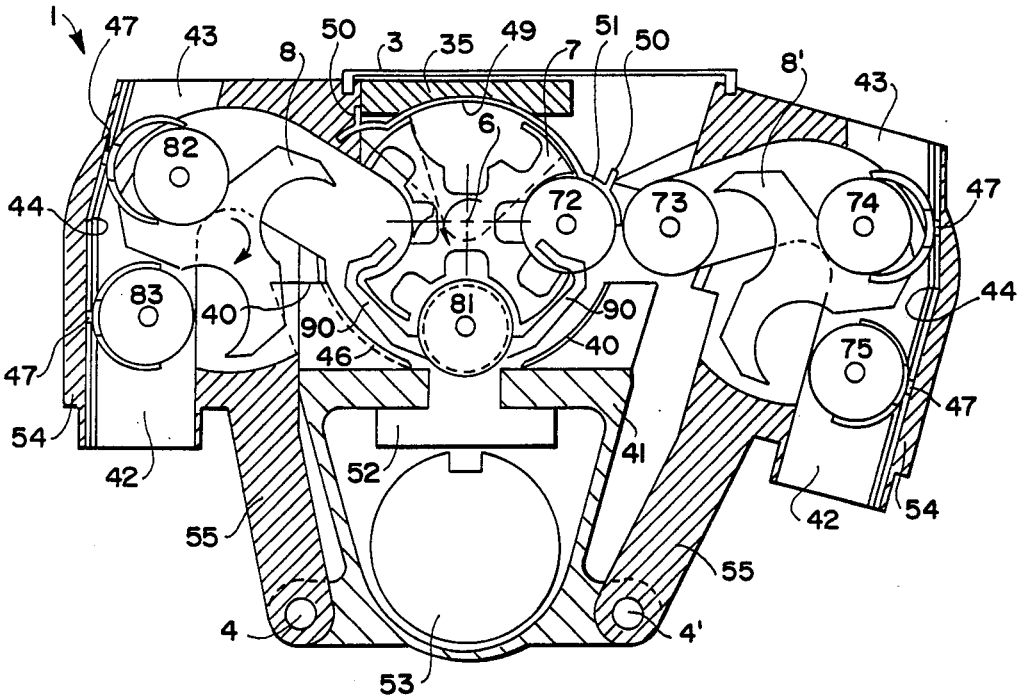
Figure 11E:
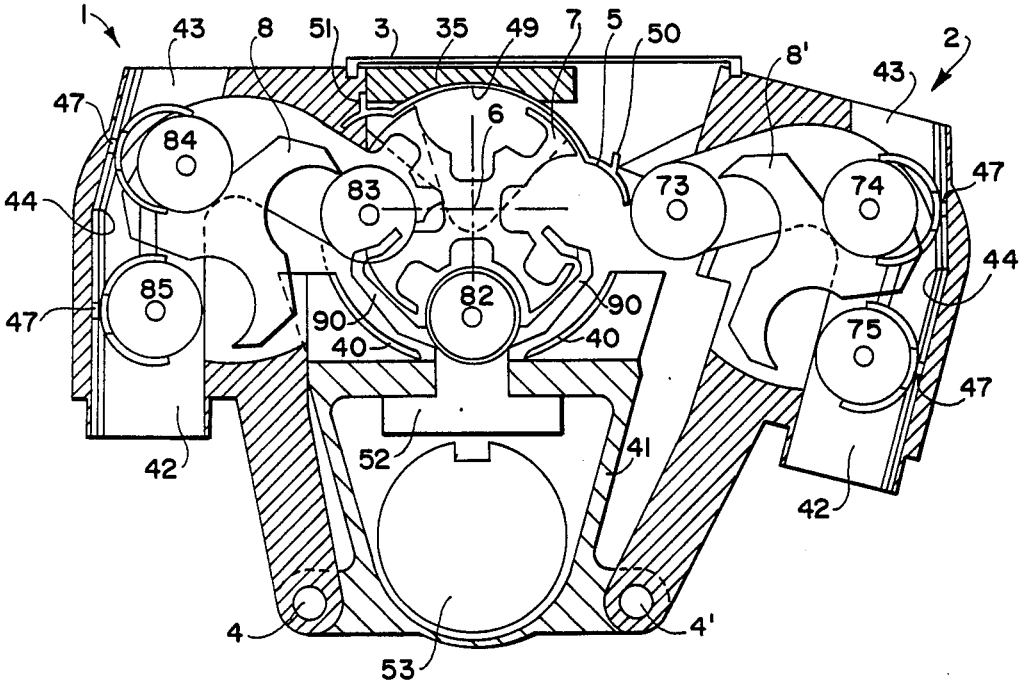
Figure 12A:
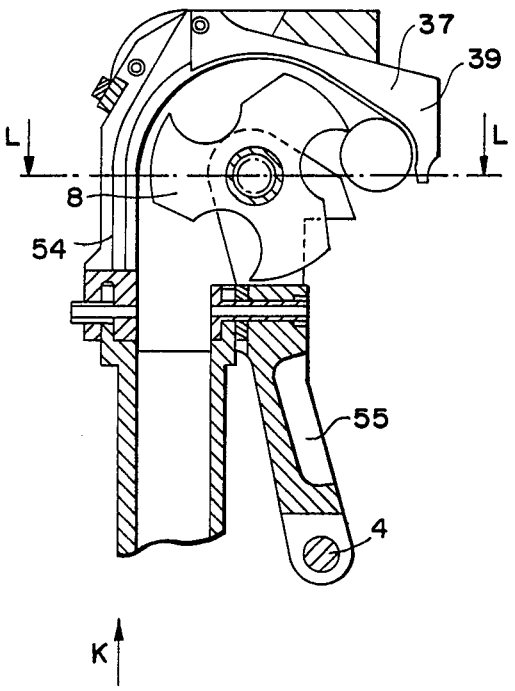
FIG. 12*a* is a section according to JJ of FIG. 1, showing the dual feed device without ammunition.
Figure 12B:
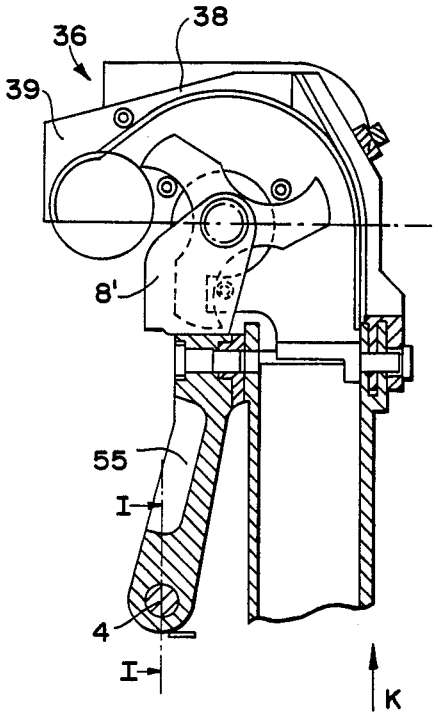
FIG. 12*b* is a section according to EE of FIG. 1.
Figure 12C:
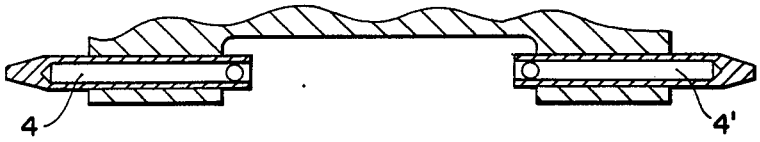
FIG. 12*c* is a detail of the case fastening onto the breech case of the weapon according to section II of FIG. 12*b;*

The feed casings 1 and 2 are placed at the level of the breech case 41 of the weapon and they include a body 54 which has two arms 55 that enable the articulation of casings on the breech case with rotation axes 4 and 4' parallel to the lengthwise axis of the weapon (FIGS. 11 and 12).

In another version which was not depicted here, the arms 55 can be bent and articulated on a single axis which is connected to the breech case and placed beneath the control drum 53.

Figure 4:
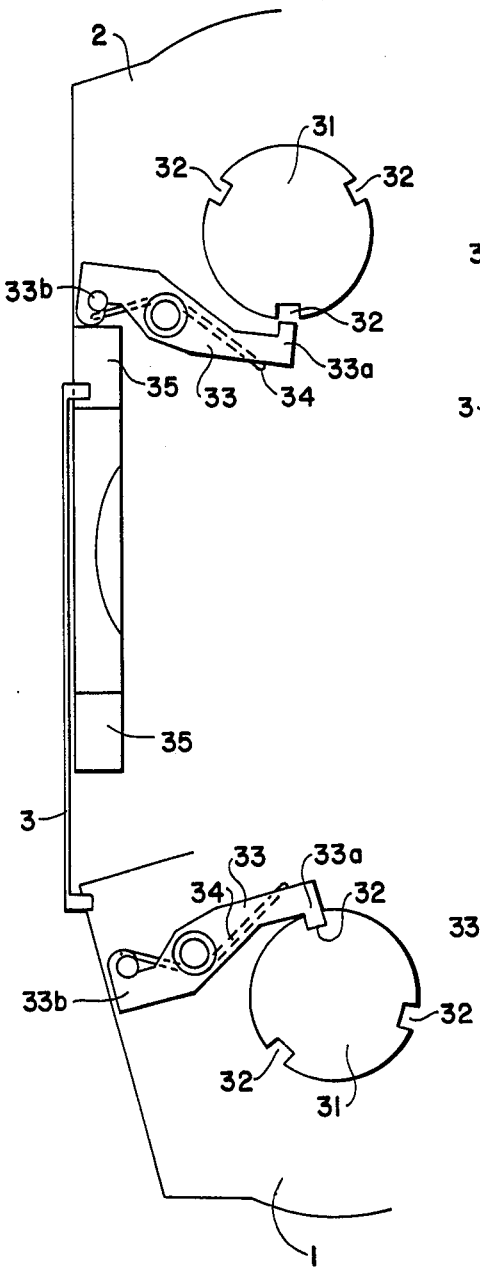
FIG. 4 is a partial view according to GG of FIG. 2.
Figure 3:
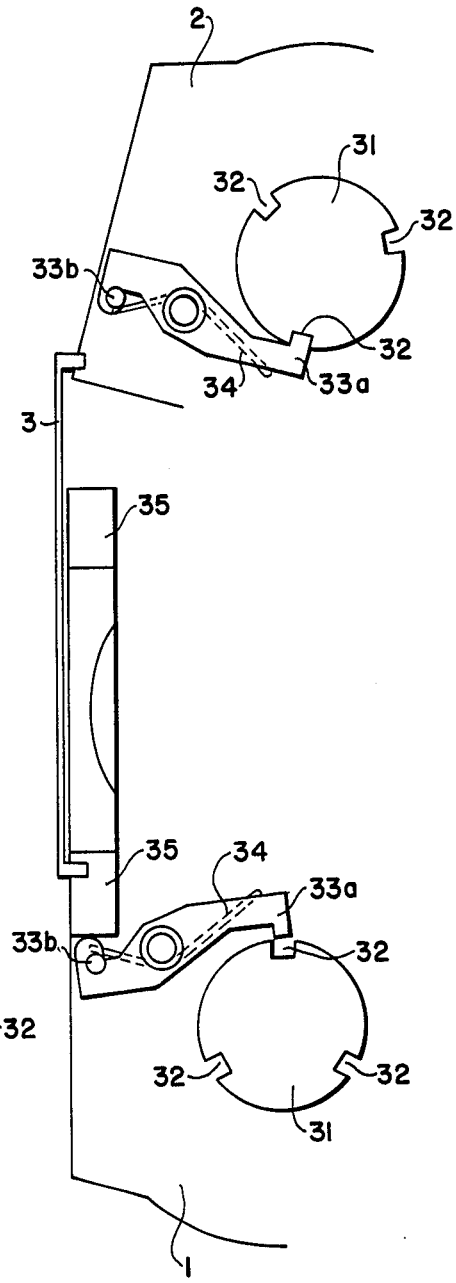
FIG. 3 is a partial view according to GG of FIG. 1.
Figure 5:
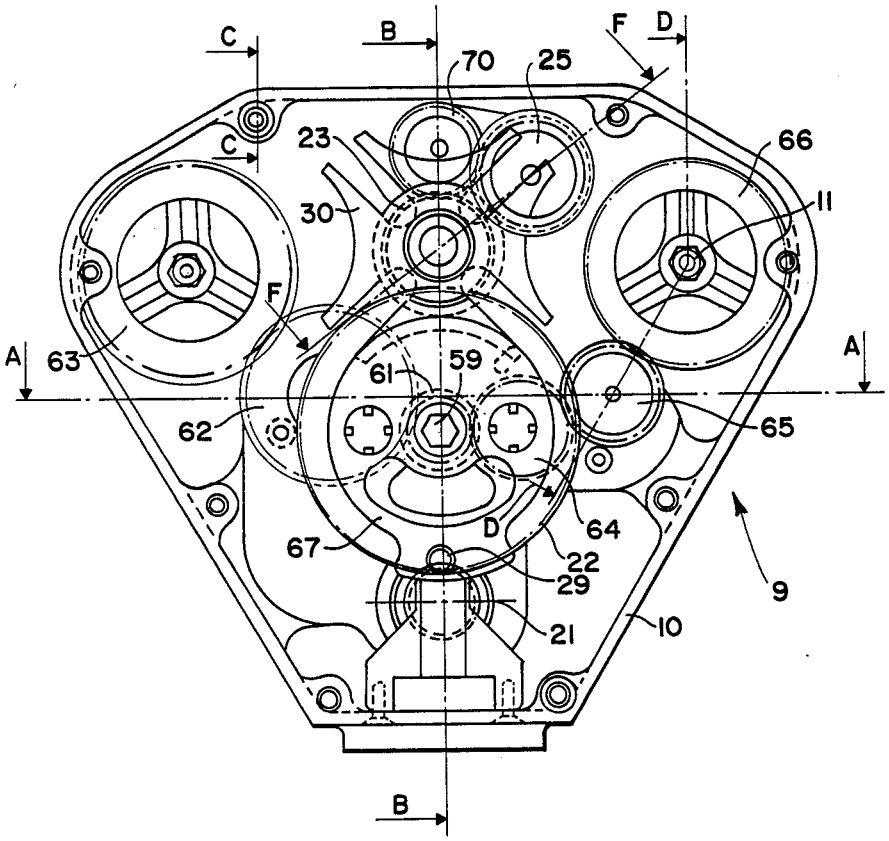
FIG. 5 is a view of the rear reducing transmission case, its top having been removed.

The two feed casings 1 and 2 are connected between them at the part which is opposite 4 and 4' by a joint linkage support which can be formed by one or more connecting rods 3 so that the engagement (and clearing) tilt of one of the casings simultaneously implies the clearing (and engaging) tilt of the opposing feed casing (FIGS. 3, 4 and 11).

The tilt control of the casings 1 and 2 is ensured by a control device 16 (see FIGS. 1 and 2) which includes a control lever 17 which is articulated around an axis 17', connected to a toothed sector 19 that cooperates with a rack 20 which is connected to the linkage support 3 of the two casings.

The lever 17 cooperates with two locking means 18 (bushings, locking slugs or any other means) placed on the rear case 10 so that the feed casings are locked securely in each of their respective operating positions.

Furthermore, the axle 12 carries a fork 27 which is mounted to rotate in order to cooperate with a cam or a tilted ramp 28 that is connected to the link support 3. This ramp 28 is tilted crosswise to the lengthwise axis of the weapon within an angle included between 20 and 45 degrees, the two ends of the ramp being perpendicular to the axis of the weapon.

During the tilt of the casings around the axes 4, 4' with the control device 16, the ramp 28 moves crosswise to the axis of the weapon shifting fork 27 lengthwise. Thus, the latter controls the lengthwise shift of axle 12 around which it is connected, the axle 12 being a control means for changing the rotational direction of the central sprocket unit so that the central sprocket unit always turns in the direction opposite to the feed sprocket unit which is engaged to the positioning device, regardless of the operating feed casing.

To this end, the axle 12 is equipped at its free end with claw couplings 26 (FIGS. 6 and 8) which couple it or uncouple it, according to the lengthwise position of the fork 27, to a reverse pinion 25 of the rotating step-by-step transmission for the central sprocket unit, the pinion being placed in the rear case 10 which will be described below.

The casings 1 (left casing) and 2 (right casing) each include a feed sprocket unit (5 and 5' respectively) which is comprised of a rotation axle (15 and 15') each carrying two feed sprockets (sprockets 8 of the left casing and 8' of the right casing), axles 15 and 15' rotatably mounted inside bores 56 of the body with combined thrust-needle bearings.

Figure 14:
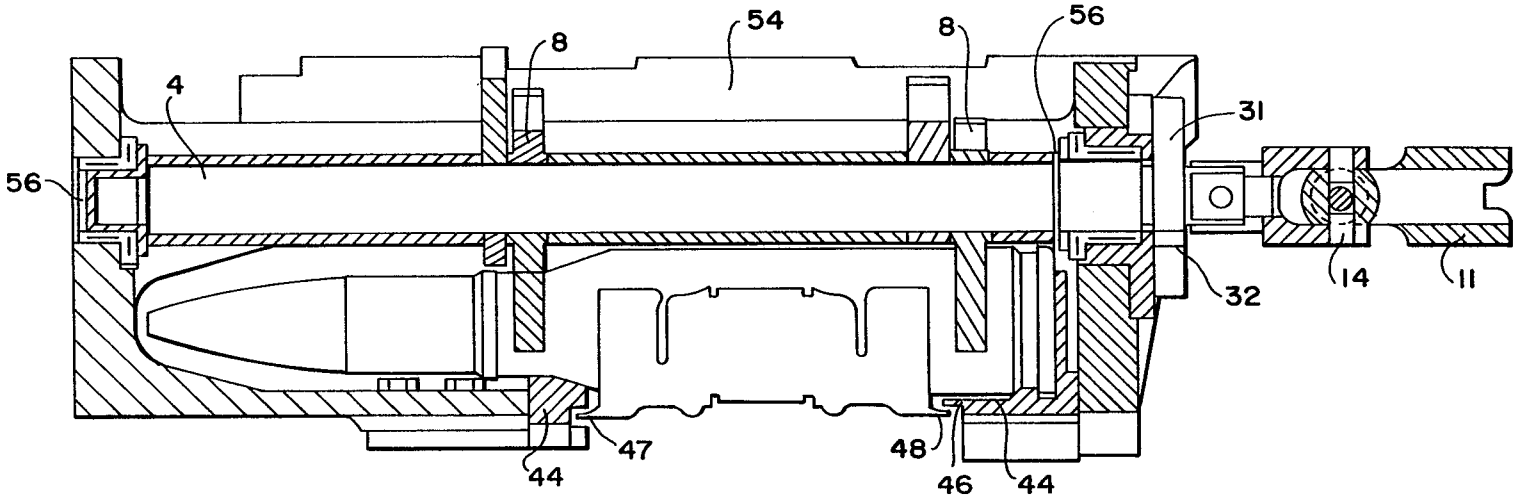
* and FIG. 14 is a section according to LL of FIG. 12*a*.

The feed units 5 and 5' are driven in rotation by control axles 11 and 11' themselves driven in a continuous way by the reducing transmission 9 of the rear case 10 (FIGS. 1, 2 and 14).

However, axles 11 and 11' each include two universals 14, 14', to enable continuity in the transmission of motion when the casings begin to tilt while the axle of the feed sprocket unit of the casing which is being uncoupled starts to be skewed from the axis of the output pinion of the rear case as it is portrayed in FIGS. 1 and 2.

Moreover, between the two universals 14 and 14' of each axle 11 or 11', there is a continuity solution which makes it possible to drive in rotation with claw couplings 13 or 13' the axles 15 or 15' of each feed unit when the concerned casing is engaged with the positioning device and to cease the rotation drive when the casing is tilted away from the positioning device.

To this end, the axles 11 and 11' are each divided into two half-axles, one of which includes pins (131 or 131'), the other notches 132 (132'), the two half-axles being kept in the same axis by a centering slug 57 from the first half-axle that cooperates with a bore 58 from the second half-axle (FIG. 9).

Furthermore, the rotation axles 15 and 15' of the feed sprocket units have a shoulder 31 outside of the case (or inside, a variation which is not depicted) that includes grooves 32 which are able to cooperate, when the casings tilt, with levers 33 that are borne by each casing in order to enable the rotation locking (or indexing) of the feed sprocket unit which is being released and the unlocking (or de-indexing) of the feed sprocket unit during engagement (FIGS. 3 and 4).

Each lever 33, which is maneuvered against a spring 34, has an initial curved end 33*a* that cooperates with a groove 32 of the shoulder 31 and a second end 33*b* which leans on the truss 35 of the breech casing when the concerned feed casing is engaged with the axle of the positioning device and hence frees for rotation the axle of the concerned feed sprocket unit, while as regards the second feed casing which is released, the lever 33 prevents feed sprocket unit rotation.

As shown in FIG. 3, the sprocket unit of the engaged left casing is free to rotate while that of the right casing, which is not engaged, is locked by the right lever 33, FIG. 4 depicting a reverse view, the right casing engaged with its right feed sprocket unit turning and the left casing released with its feed unit indexed.

In order to avoid the risk of non-operation which stems from ill positioning of the feed sprockets in relation to the central sprocket while the casings tilt, the size of the claw couplings 13, 13' and the shape of the levers 33 are planned in such a way that while the casings 1 and 2 tilt, the indexing of the sprocket unit on its casing during release (5, FIG. 4, for instance) is performed before the uncoupling of its drive axle 11, and simultaneous coupling of the drive axle 11' of the casing 2 should take place prior to its de-indexing in relation to the casing.

With respect to the reducing transmission 9, and by referring in particular to FIGS. 5 through 8, we note that placing the rear case in motion starts with the rotation of the control drum 53, which is itself driven by the external motor, that has a drive pinion 21 on its axle end. The pinion 21 drives a pinion 22 which is connected to an axle 59 that is rotatably mounted within bearings 60. The axle 59 also carries a pinion 61 which drives the two casing feed units:

for the left casing with an intermediate pinion 62 that is geared on the toothed wheel 63 of the drive axle 11 of the left casing;

for the right casing with two intermediate toothed wheels 64 and 65, the pinion 65 driving the toothed wheel 66 of the drive axle 11' of the right casing.

Thus, the axles 11 and 11' rotations are in opposite directions, and they are driven continuously which makes it possible to drive the loading belt without jerks, therefore without risking a break or a sudden unhooking of the links.

The drive of the central sprocket unit is performed from the toothed wheel 22 which is borne by the axle 59 that is connected to an off-center crank pin 29 (depicted in FIG. 5 of which only the axis is shown in FIG. 6) borne by a turning stand 67. The crank pin 29 cooperates with a Maltese cross 30 which is connected to an axle 68 mounted with a combined thrust-bearing 69 on the rear of the body and a bearing 69' on an end axle 12 cylindrical neck. In the implementation mode which is depicted here, the Maltese cross 30 has 4 teeth as does the positioning central sprocket while the feed sprockets of the casings have 3 teeth so that the drive axle 12 and therefore the central sprocket 7 rotate sequentially by $\frac{1}{4}$ turn while the feed sprockets rotate continuously by $\frac{1}{3}$ turn.

Regardless of the engaged casing, in order to ensure that the weapon works, it is necessary for the central positioning sprocket unit to turn in the direction opposite from that of the engaged feed sprocket unit. Therefore, it is necessary to plan a rotational direction change system for the central sprocket unit while the casings tilt. The rotational direction change system includes for this purpose the dual reversing pinion 25 which is driven by the toothed wheel 23, that is geared to a pinion 70.

The operation of the reversing pinions 25 and 70 is controlled by claw couplings 26 through the lengthwise displacement of the axle 12 while the casings tilt as described above.

As depicted in FIGS. 6 and 8, the claw couplings 26 of the axle 12 are in direct engagement with corresponding notches of the pinion 23 and in the case of FIG. 1 the left casing is engaged with the ammunition positioning device. In this instance, the pinion 23 that is connected to the Maltese cross 30 drives the wheel 25 which is geared to the pinion 70, itself driving the pinion 24. Since the latter is not engaged on the claw couplings 26, it turns loosely on the axle 12.

When we enter the operating mode of FIG. 2 (engaged right casing), the tilt of the lever 17 has driven the displacement of the fork 27 and the ramp 28, hence, the drive axle 12 was shifted lengthwise toward the front part of the weapon. The claw couplings 26 which it bears were released from the pinion 23 and they were engaged on corresponding grooves from the pinion 24. Therefore, the reversing train 25, 70 drives the pinion 24 and, therefore, the axle 12 in a rotational direction opposite the rotation of the Maltese cross 30. The central positioning sprocket unit changes rotational direction and therefore is able to take the ammunition from the feed sprocket unit of the right casing which is then engaged.

In order to complete the dual feed device and to enable the first ammunition of the belt-loader to be stripped first (rather than the last ammunition of the opposing previously selected belt-loader), each feed casing includes an ammunition guide 36 which is comprised of a front fork 37 and a rear fork 38 on which the ammunition stands while it is handled by the feed sprocket unit 5 (or 5'). The front fork 37 has a curved neck 39 which acts, when the casing is engaged, as an additional support for the ammunition, and when the casing tilts while being released, it can drive the ammunition in the waiting position towards the outside of the central sprocket unit, into a position where the ammunition thus stripped no longer hampers the operation of the central sprocket unit of which the rotational direction was simultaneously reversed with the reversing train 25, 70.

The device also includes an ejection guide 49 which is rotatably mounted in relation to axis 6 of the central sprocket unit and symmetrically in relation to the lengthwise axis of the weapon. The guide 49 is rotatably displaced by the tilt of casings 1 and 2, the guide 49 then being positioned in each of its operating positions by two thrusts 50 in relation to the girder 35 of the breech case.

The ejection guide includes round bearings 51 for lengthwise guidance of the shell (pushed by the pusher 90 of the bolt 52) during its lengthwise ejection shift forward.

The operating sequences of the dual feed device according to the invention can be made explicit in relation to FIGS. 11*a* through 11*e*.

If we refer to FIG. 11*a*, the right casing is engaged with the positioning device (in the position depicted in FIGS. 2 and 4).

The feed sprocket 8' turns driven by the axle 11', and the central positioning sprocket 7 turns in the direction opposing that of the sprocket 8'. The sprocket 8 is static, locked by the lever 33 (see FIG. 4).

A belt-loader is engaged at the bottom of the casing inside an inlet channel 42 running along the entire height of the feed casing.

Ammunition 71 is in the firing station and is about to be engaged forward inside the breech (where it will be fired) through the lengthwise shift of the bolt 52 that is driven by the control drum 53.

Figure 13:
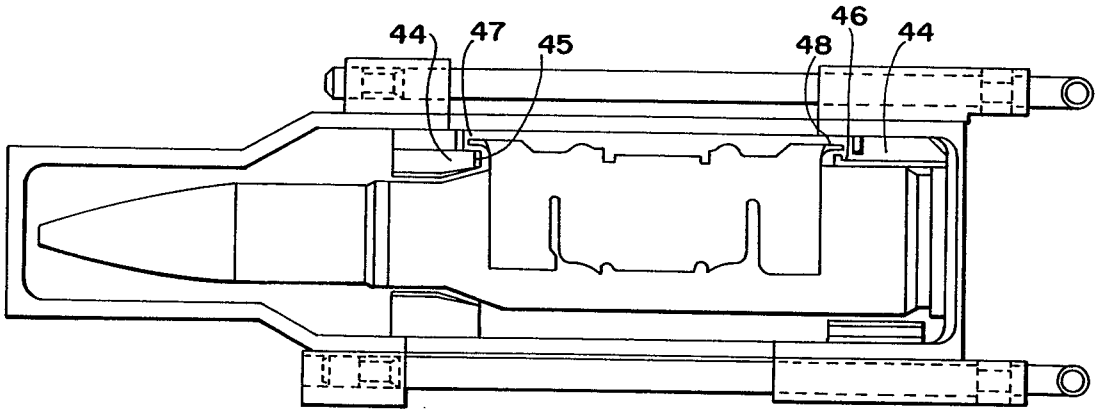

The rotation of sprocket 8' simultaneously places in the waiting position the following ammunition 72. Ammunition 73 which is also driven by the sprocket 8' is being released from its link, the latter equipped with tongues 47, 48 that slide inside the grooves 45, 46 of the link guide 44 (FIG. 13). Then, the link is wrenched radially from the ammunition and driven towards the ejection orifice 43 that is placed atop the casing.

In the following FIG. 11*b*, the bolt 52 has gone back and forth and is in the rear position. When it is in that position, the central sprocket performs a quarter turn rotation which brings the fired ammunition 71 in an ejection position and the ammunition 72 in the firing position, ammunition 73 ready to be placed in the waiting position.

During the following alternate movement of the bolt, the central sprocket 7 is stopped, the shell 71 is ejected to the front of the weapon by an ejection pusher 90 which is connected to the bolt, and the ammunition is fired.

FIG. 11*c* depicts the device when the tilt of the casings has just taken place.

The bolt 52 is in the rear position, with no engagement between the breech and the trigger.

Ammunition 73 which should have been at the waiting station was placed out of reach of the central positioning sprocket by the neck 39 of the front fork of the right casing ammunition guide during its release. While the ammunition 73 was being withdrawn, the latter was guided leaning on the floor guide 40 of the breech case.

The feed sprocket 8' was simultaneously indexed in relation to the casing 2 by its lever 33 right before being uncoupled from its drive axle 11' by the claw couplings 13' and its operation was thus brought to a halt. In the meantime, the claw couplings 13 of the drive axle 11 of the casing 1 were engaged and the axle 11 was de-indexed from the casing 1, its lever 33 (FIG. 3) resting on the girder 35.

The tilt of the casings simultaneously shifted the axle 12 to the rear (FIG. 1), which released the claw couplings 26 from the pinion 24 and engaged them onto the pinion 23. Hence, the central sprocket changed its rotational direction.

The tilt of the casing towards the breech case drove the rotation of the ejection guide 49 to the right until it was acted upon by thrust 50 on girder 35.

Therefore, the sprocket 8 and the central sprocket 7 now turn in opposite directions and the first ammunition 81 from the left casing is in the waiting position.

Ammunition 72, which has just been fired, instead of being ejected from the left side of the weapon, will be driven to the right, the former waiting position of the right casing thereby becoming the ejection station of the shell 72 which is guided by the ejection guide 49 (FIG. 11*d*).

During the quarter turn rotation of the central sprocket 7 which placed the shell 72 into the ejection station to the right, the ammunition 81 is at its firing station. A new alternate lengthwise motion of the bolt 52 will drive forward the ammunition 81 which will be fired and the shell 72 will be ejected.

FIG. 11*e* shows the continuation of the operating sequence for the left feed casing 1, after the shell 81 is ejected from the right, when the ammunition 82 is at the firing station and the following ammunition 83 at the waiting station.

The bolt 52 will perform a new alternate motion either latching on to the trigger, or continuing another cycle according to the selected firing mode.

Therefore, the device as it is described makes it possible to obtain excellent firing regularity, at a high rate with a dual feed device that operates symmetrically and enables a very rapid change of the feed mode when the breech is not engaged with the trigger since all the necessary moves for the feed change (tilting the casings, indexing and uncoupling of the released feed sprocket unit, de-indexing and coupling of the engaged feed sprocket unit) simultaneously take place with one step performed by the user on the tilt lever 17.

Furthermore, without exceeding the framework of the invention, the tilt operation of the lever 17 can even be mechanized. The lever 17 can then be replaced by any electric drive motor which acts on the toothed section 19, the locking of the device in its operating position being ensured by the idle position of said drive motor.

We claim:

1. A dual feed device for a weapon comprising:

an external motor;

a rectilinearly shifting breech;

a positioning device for ammunition that includes a central positioning sprocket unit (7) and two feed casings (1, 2) loaded with various ammunition placed on either side of the central positioning sprocket unit and connected to one another by a common support (3), both casings being tiltable around axes (4, 4') that are parallel to the lengthwise axis of the weapon;

the device being further characterized in that each feed casing includes a unit (5, 5') of feed sprockets (8, 8'), and in that each casing is able, by tilting, to be coupled with the positioning device by coupling the feed sprocket unit of said each casing onto a reducing transmission (9), the coupling of one feed casing being followed by the simultaneous uncoupling of the other feed casing from the positioning device by uncoupling the feed sprocket unit of said other feed casing from the reducing transmission; and the device being further characterized in that the tilt of the casings causes a change in rotational direction of the central positioning sprocket unit.

2. The dual feed device according to claim 1, wherein the external motor drives the reducing transmission which in turn drives two drive axles (11, 11') of the feed casings and a third drive axle (12) of the central positioning sprocket unit.

3. The dual feed device according to claim 2, wherein the reducing transmission drives the two drive axles (11, 11') of the feed casings in continuous fashion with reduction, the drive axle (11) of the first feed casing turning in a reverse direction from that of the second feed casing, and further wherein, when combined, the motion transmitted to the third drive axle (12) of the central positioning sprocket unit is step-by-step transmission, said drive axle of the central positioning sprocket unit turning in the reverse direction from that of the drive axle of the feed casing coupled with the positioning device.

4. The dual feed device according to claim 3, further comprising a unit (16) for controlling the tilt of the feed casings around their rotational axes, the tilt control activating a coupling system (13, 13') of the drive axle of a first feed casing which is coupled to the positioning device with a universal (14, 14') on a rotation axle (15, 15') connected to the feed sprockets of said first feed casing, and simultaneously activating an uncoupling system (13', 13) of the drive axle of a second feed casing and a rotational direction change system of the positioning central sprocket unit, so that the rotational direction of the central sprocket unit is always the reverse of that of the feed sprocket unit coupled to the positioning device.

5. The dual feed device according to claim 4, wherein the control unit for the tilt of the casings includes a control lever (17) that cooperates with a locking means (18) of the feed casings in each tilted position, the control lever then being locked onto the case (10) of the reducing transmission.

6. The dual feed device according to claim 4, wherein the control lever (17) for the tilt of the casings is connected to a mobile toothed sector (19) around an axis and cooperating with a rack (20) borne by the common support (3) of the two feed casings.

7. The dual feed device according to claim 4, wherein the rotational direction change system of the central positioning sprocket unit during the tilt of the casings includes:

a non-reversing gear train (21, 22, 23, 24) for providing step-by-step transmission of motion to the central positioning sprocket unit;

a reversing pinion (25) which can be series mounted in the gear train (21 through 24), when it is coupled to a drive axle (12);

an axle (12) which is equipped with claw couplings (26) and which is mobile in a lengthwise direction of the weapon; and an axle which is driven by a connected fork (27) engaged on a ramp (28) which is tilted in relation to the lengthwise axis of the weapon and which is connected to the common support (3) of the two casings, the tilt of the casings causing a shift of the ramp perpendicular to the axis of the weapon and hence a lengthwise shift of the axle (12) from an initial position where it is uncoupled from the reversing pinion (25) to a second position where it is coupled to the reversing pinion in order to reverse the direction of motion of the central positioning sprocket unit (7).

8. The dual feed device according to claim 3, wherein the step-by-step transmission of motion to the central positioning sprocket unit is provided by a turning crank pin (29) which cooperates with a Maltese cross (30).

9. The dual feed device according to claim 4, wherein the rotation axle (15, 15') of the feed sprocket unit of each casing carries a shoulder (31) which includes indexing grooves (32), and further wherein each casing carries an indexing lever (33) which is mobile against the force of a spring (34), whereby when the casing is released from the positioning device, a first end (33*a*) of the indexing lever cooperates with a groove (32) of the shoulder (31) of the axle of the feed sprocket unit, a second end (33*b*) of the indexing lever being free to cause the feed sprocket unit of said casing to be disconnected from rotation, and further whereby when the casing is engaged on the positioning device, the second end (33*b*) of the indexing lever (33) rests on a static girder (35) of a breech case of the weapon, the first end (33*a*) of the lever being released from the groove of the axle shoulder of the feed sprocket unit in order to enable its rotation.

10. The dual feed device according to claim 9, wherein the rotation axle (15, 15') of each feed sprocket unit includes as many grooves (32) which are regularly distributed at the periphery of its shoulder (31), as feed sprockets (8, 8') include teeth.

11. The dual feed device according to claim 9, wherein the shape of the indexing lever (33) and the size of the coupling system (13, 13') of the drive axle of the casing are defined in order to enable the indexing of the feed sprocket rotation axle (15, 15') in relation to the casing (1, 2) before uncoupling the drive axle of the casing when the latter tilts in a released position, and the de-indexing of the feed sprocket rotation axle (15, 15') in relation to the casing (1, 2) after coupling the drive axle of the casing when the latter tilts in an engaged position on the positioning device, indexing of the feed sprocket axle occurring when the weapon is in a position where there is no engagement between the breech and the trigger.

12. A dual feed device according to claim 2, wherein the central positioning sprocket unit (7) has n teeth and each feed sprocket (8, 8') has n' teeth, and further wherein the reducing ratio between the motion supplied to the reducing transmission (9) by the control drum of the bolt and the drive axle (12) of the central positioning sprocket unit equals n, and the reducing ratio between said motion supplied to the reducing transmission and the drive axle (11, 11') of each feed sprocket unit is equal to n stepped up to n'.

13. The dual feed device according to claim 1, wherein the central positioning sprocket unit (7) includes n teeth that define n chambers, n being at least equal to 3, each chamber being able to accommodate ammunition conveyed by the feed sprockets (8, 8') of the engaged casing and going in succession from a position where the ammunition is waiting through $2\pi/n$ turns, to a positioning station, then to an ejection position of the ammunition shell, whereby when the feed casings tilt, the central positioning sprocket unit changes its rotational direction, the ejection position then becoming the waiting position of the ammunition that is conveyed by the second casing which is engaged and the waiting position becoming an ejection position.

14. The dual feed device according to claim 1, wherein each feed casing (1, 2) has a curved ammunition guide (36) that includes a front fork (37) and a rear fork (38), the guide conveying the ammunition towards the feed sprockets (8, 8') of the casing and towards the central positioning sprocket unit (7) in the waiting position, and further wherin the free section of the front fork of the ammunition guide has a curved neck (39) which encloses the ammunition when it is in its waiting position inside the central positoning sprocket unit, the neck being able to release the ammunition from the waiting position during the release tilt of the feed casing in relation to the breech case, the ammunition during its withdrawal leaning on a floor guide (40) that is connected to the breech case.

15. The dual feed device according to claim 1, wherein each feed casing has an inlet channel (42) for linking an ammunition belt through the bottom of the casing and a link ejection orifice (43) placed on top of the casing, and further wherein the casing has a link guide (44) which is placed alongside the entire length of the ammunition inlet (42) and link ejection (43) channel, the link guide (44) including a dual groove (44, 46) which cooperates with a dual tongue (47, 48) for each link in order to allow for the stripping of the ammunition by the feed sprockets of the casing.

16. The dual feed device according to claim 13, wherein the ejection of the shell from the ejection station takes place towards the front of the weapon, and further wherein the dual feed device includes an ejection guide (49) which is rotatable about the axis (6) of the central positioning sprocket unit (7) and symmetrical in relation to the lengthwise axis of the weapon, and which is further rotated by the tilt of the feed casings, the guide (49) being positioned in each of its operating positions with a thrust (50) against a static girder (35) that is connected to the breech case, and the ejection guide including round bearings (51) for lengthwise guidance of the shell while it is being ejected.

* * * * *